US006484797B2

(12) United States Patent
Saito et al.

(10) Patent No.: US 6,484,797 B2
(45) Date of Patent: Nov. 26, 2002

(54) LAMINATED TYPE HEAT EXCHANGER

(75) Inventors: Katsuhiro Saito, Nishi-kasugai-gun (JP); Masashi Inoue, Nishi-kasugai-gun (JP); Yoshinori Watanabe, Nagoya (JP); Akira Yoshikoshi, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/900,947

(22) Filed: Jul. 10, 2001

(65) Prior Publication Data

US 2002/0046827 A1 Apr. 25, 2002

(30) Foreign Application Priority Data

Oct. 20, 2000 (JP) ..... 2000-321664

(51) Int. Cl.[7] ..... F28F 9/02
(52) U.S. Cl. ..... 165/153; 165/174
(58) Field of Search ..... 165/152, 155, 165/153, 174

(56) References Cited

U.S. PATENT DOCUMENTS

| | | | | | |
|---|---|---|---|---|---|
| 3,908,758 | A | * | 9/1975 | Armonies et al. | 165/174 |
| 3,976,128 | A | * | 8/1976 | Patel et al. | 165/174 |
| 4,274,482 | A | * | 6/1981 | Sonoda | 165/153 |
| 5,651,268 | A | * | 7/1997 | Aikawa et al. | 165/174 |
| 5,984,000 | A | * | 11/1999 | Nakamura et al. | 165/153 |
| 6,161,616 | A | * | 12/2000 | Haussmann | 165/153 |
| 6,199,401 | B1 | * | 3/2001 | Haussmann | 165/153 |
| 6,318,455 | B1 | * | 11/2001 | Nakado et al. | 165/153 |

FOREIGN PATENT DOCUMENTS

| | | | | |
|---|---|---|---|---|
| JP | 61-161398 A | * | 7/1986 | 165/153 |
| JP | 3-191296 A | * | 8/1991 | 165/153 |
| JP | 6-159983 A | * | 6/1994 | 165/153 |
| JP | 8-86591 | | 4/1996 | |
| JP | 9-196595 | | 7/1997 | |
| JP | 11-142083 | | 5/1999 | |

* cited by examiner

*Primary Examiner*—Henry Bennett
*Assistant Examiner*—Terrell McKinnon
(74) *Attorney, Agent, or Firm*—Oblon, Spivak, McClelland, Maier & Neustadt, P.C.

(57) ABSTRACT

A laminated type heat exchanger including a refrigerant inlet tank and a refrigerant outlet tank. The inlet tank has inlet chambers and a refrigerant passage passing through the inlet chambers, and the outlet tank has outlet chambers and a refrigerant passage passing through the outlet chambers. The heat exchanger includes refrigerant pipes each having one end which is connected to the inlet chamber and the other end which is connected to the outlet chamber, and a refrigerant gate portion for flowing the refrigerant into the inlet tank and from the outlet tank. The heat exchanger also includes a dispersion pipe which is inserted in the inlet tank refrigerant passage. The dispersion pipe is about ⅓ to ¼ of the length of the inlet tank refrigerant passage, and the sectional area of the dispersion pipe is smaller than that of the inlet tank refrigerant passage. Dispersion holes are formed at the opposite side of the dispersion pipe against the refrigerant pipe, and the size of the dispersion holes increases with the increase in the distance from the gate portion.

8 Claims, 6 Drawing Sheets

LAMINATED TYPE HEAT EXCHANGER

BACKGROUND OF THE INVENTION

1. Field of the Invention

The present invention relates to a laminated type heat exchanger used for an evaporator comprising an air conditioner mounted in a car.

2. Description of the Related Art

FIGS. 5 and 6 are a partial side view and a partial plan view which show a conventional laminated type heat exchanger used for an evaporator comprising an air conditioner mounted in a car, and FIG. 7 is a sectional view showing a cross-section along line A—A of FIG. 6.

In FIGS. 5, 6, and 7, a laminated type heat exchanger 1 comprises a plurality of tube elements 2 and cooling fins 4 which use air. The tube elements 2 are arranged parallel to each other with the cooling fins inter posed therebetween. The tube elements 2 and the cooling fins 4 are integrally soldered.

The tube element 2 comprises a pair of molded plates 2*a* and 2*b*. A refrigerant inlet chamber 20*a*, a refrigerant outlet chamber 20*b*, and a U-shaped refrigerant pipe 21 are formed by attaching the molded plates 2*a* and 2*b*. The refrigerant pipe 21 connects the refrigerant inlet chamber 20*a* with the refrigerant outlet chamber 20*b*. Therefore, the refrigerant flows from the refrigerant inlet chamber 20*a* to the refrigerant outlet chamber 20*b* via the refrigerant pipe 21. Moreover, a wave shaped plate 3 is mounted in the refrigerant pipe 21.

An end tube element 50 is formed by attaching an end plate 5 to the molded plate 2*b* which is positioned at one side of the laminated type heat exchanger 1. An end tube element 60 is formed by attaching an end plate 6 to the molded plate 2*a* at the other end of the laminated type heat exchanger 1. Thereby, a refrigerant inlet tank comprising a plurality of refrigerant inlet chambers 20*a* and a refrigerant outlet tank comprising a plurality of refrigerant outlet chambers 20*b* are formed.

A refrigerant gate portion 7 is soldered to the end tube element 50. The refrigerant gate portion 7 comprises a front plate 70 having flanges 9*a* and 9*b* for mounting an expansion valve 10, and a connection plate 8 having a passage 80*a* for flowing the refrigerant to the refrigerant inlet tank and a passage (not shown in the figures) for flowing the refrigerant from the refrigerant outlet tank.

In this conventional laminated type heat exchanger 1, the flow rate of the refrigerant send by the expansion valve 10 into the refrigerant inlet tank is not sufficient. Therefore, a short circuit is generated. In other words, most of the refrigerant send by the expansion valve 10 flows into the refrigerant pipe 21 arranged near the refrigerant gate portion 7, and reaches the refrigerant outlet tank. It is difficult for the refrigerant to reach the inner laminated type heat exchanger 1, namely the end tube element 60. A problem arises in that the refrigerant cannot be dispersed uniformly.

In consideration of the above described problem of the conventional technology, an object of the present invention is to provide a laminated type heat exchanger which can disperse the refrigerant uniformly.

SUMMARY OF THE INVENTION

A first laminated type heat exchanger of the present invention comprising:

a refrigerant inlet tank comprising a plurality of refrigerant inlet chambers, and in which a refrigerant passage passing through the refrigerant inlet chambers is formed;

a refrigerant outlet tank comprising a plurality of refrigerant outlet chambers, and in which a refrigerant passage passing through the refrigerant inlet chambers is formed;

a plurality of refrigerant pipes each having one end which is connected to the refrigerant inlet chamber and the other end which is connected to the refrigerant outlet chamber;

a refrigerant gate portion for flowing the refrigerant into the refrigerant inlet tank and from the refrigerant outlet tank;

a dispersion pipe which is inserted in the refrigerant passage formed in the refrigerant inlet tank;

wherein the length of the dispersion pipe is ⅓~¼ of the length of the refrigerant passage in the refrigerant inlet tank, the sectional area of the dispersion pipe is smaller than that of the refrigerant passage in the refrigerant inlet tank, a plurality of dispersion holes are formed at the opposite side of the dispersion pipe against the refrigerant pipe, and the size of the dispersion holes increases with an increase in the distance from the refrigerant gate portion.

According to the first laminated type heat exchanger, a refrigerant in the dispersion pipe passes through the refrigerant inlet tank with maintaining a sufficient flow rate. Therefore, the refrigerant reaches the inner refrigerant inlet chambers. Moreover, the size of the dispersion holes increases with an increase in the distance from the refrigerant gate portion. Therefore, the refrigerant flows uniformly into the refrigerant pipes connected to the refrigerant inlet chambers. Then, the refrigerant is dispersed uniformly in the laminated type heat exchanger.

In a second laminated type heat exchanger of the present invention, at least one dispersion plate comprising an opening is provided in the refrigerant inlet chamber in which the dispersion pipe is not inserted. The flow rate of the refrigerant increases whenever the refrigerant passes through the opening. Therefore, the flow rate of the refrigerant in the refrigerant inlet chamber, in which the dispersion pipe is not inserted, is maintained enough.

In a third laminated type heat exchanger of the present invention, a plurality of said dispersion plates are provided in the refrigerant inlet tank, and the size of the openings formed at the dispersion plates decreases with an increase in the distance from the refrigerant gate portion. According to this laminated type heat exchanger, the flow rate of the refrigerant in the refrigerant inlet chamber, in which the dispersion pipe is not inserted, is maintained more enough.

A fourth laminated type heat exchanger of the present invention comprising:

a refrigerant inlet tank comprising a plurality of refrigerant inlet chambers, and in which a refrigerant passage passing through the refrigerant inlet chambers is formed;

a refrigerant outlet tank comprising a plurality of refrigerant outlet chambers, and in which a refrigerant passage passing through the refrigerant inlet chambers is formed;

a plurality of refrigerant pipes each having one end which is connected to the refrigerant inlet chamber and the other end which is connected to the refrigerant outlet chamber;

a refrigerant gate portion for flowing the refrigerant into the refrigerant inlet tank and from the refrigerant outlet tank;

a dispersion pipe which is inserted in the refrigerant passage formed in the refrigerant inlet tank;

wherein a restrictor for restricting the flow of the refrigerant is provided at the upstream side of the refrigerant passage in the refrigerant inlet tank.

According to this fourth laminated type heat exchanger of the present invention, the nozzle restricts the flow of the refrigerant from the refrigerant gate portion. When the refrigerant passes through the nozzle, a mist flow of the refrigerant is generated. Thereby, the flow rate of the refrigerant increases. The refrigerant reaches the inner refrigerant inlet chambers, and flows into the refrigerant pipes. Then, the refrigerant is dispersed uniformly in the laminated type heat exchanger.

In a fifth laminated type heat exchanger of the present invention, the restrictor is formed at an end plate of the refrigerant inlet tank.

In a sixth laminated type heat exchanger of the present invention, the refrigerant gate portion comprises a connection plate for flowing the refrigerant into the refrigerant inlet tank, which is connected to an end plate of the refrigerant inlet tank; and a restrictor for restricting the flow of the refrigerant is provided at the connection plate.

In a seventh laminated type heat exchanger of the present invention, at least one dispersion plate comprising an opening for restricting the flow of the refrigerant is provided in the refrigerant inlet tank and/or the refrigerant outlet tank. According to the seventh laminated type heat exchanger, the flow rate of the refrigerant in the refrigerant inlet tank is maintained enough.

In a eighth laminated type heat exchanger of the present invention, a plurality of said dispersion plates are provided in the refrigerant inlet tank and/or the refrigerant outlet tank, and the size of the openings formed at the dispersion plates decreases with an increase in the distance from the refrigerant gate portion. According to the eighth laminated type heat exchanger, the flow rate of the refrigerant in the refrigerant inlet tank is maintained more enough.

DETAILED DESCRIPTION OF THE PREFERRED EMBODIMENTS

Next, a first embodiment of the laminated type heat exchanger according to the present invention will be explained referring to FIG. 1.

Figure 1:
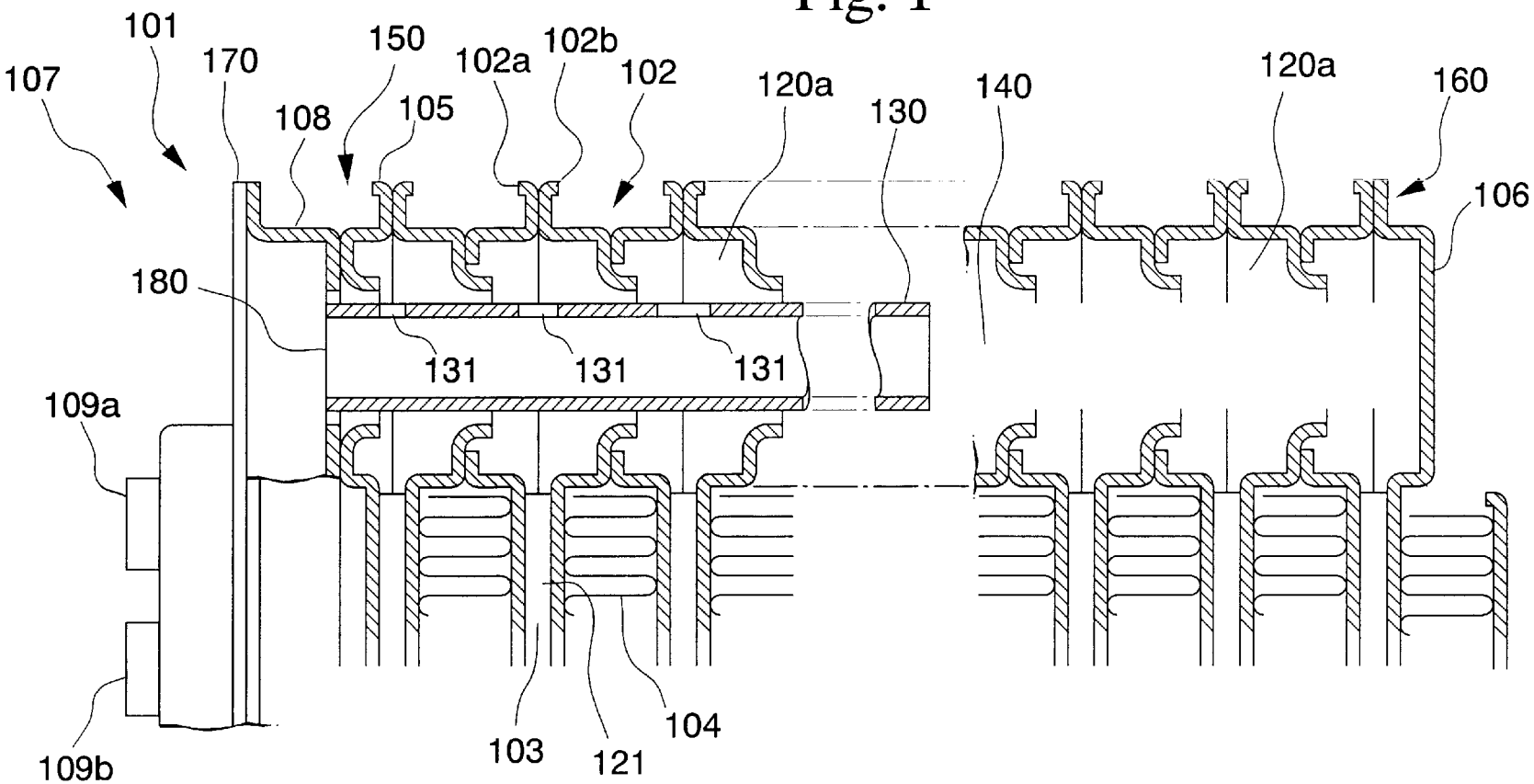
FIG. 1 is a longitudinal cross-sectional drawing showing the laminated type heat exchanger of the first embodiment according to the present invention.

In FIG. 1, a laminated type heat exchanger 101 comprises a plurality of tube elements 102 and cooling fins 104 which use air. The tube elements 102 are arranged parallel to each other with the cooling fins 4 interposed therebetween. The tube elements 102 and the cooling fins 104 are integrally soldered.

The tube element 102 comprises a pair of molded plates 102*a* and 102*b*. A refrigerant inlet chamber 120*a*, a refrigerant outlet chamber, and a U-shaped refrigerant pipe 121 are formed by attaching the molded plates 102*a* and 102*b*.

An end tube element 150 is formed by attaching an end plate 105 to the molded plate 102*b* at one end of the laminated type heat exchanger 101. Similarly, an end tube element 160 is formed by attaching an end plate 106 to the molded plate 102*a* at the other end of the laminated type heat exchanger 101. Thereby, a refrigerant inlet tank comprising a plurality of refrigerant inlet chambers 120*a* and the end tube elements 150 and 160 is formed. Moreover, an opening is formed at the molded plates 102*a* and 102*b*; therefore, a refrigerant passage 140 passing through the refrigerant inlet chambers 120*a* is formed in the refrigerant inlet tank.

One end of the refrigerant pipe 121 is connected to the refrigerant inlet chamber 120*a*. The other end of the refrigerant pipe 121 is connected to the refrigerant outlet chamber. Therefore, the refrigerant flows from the refrigerant inlet tank to the refrigerant outlet tank via the refrigerant pipes 121. Moreover, a wave shaped plate 103 is mounted in the refrigerant pipe 121.

A refrigerant gate portion 107 is soldered to the end tube element 150. The refrigerant gate portion 107 comprises a front plate 170 having flanges 109*a* and 109*b* for mounting an expansion valve, and a connection plate 108 having an opening 180 for flowing the refrigerant to the refrigerant inlet tank.

A dispersion pipe 130 is inserted in the refrigerant passage 140. One end, an upstream end, of the dispersion pipe 130 is positioned at the connection plate 108. The length of the dispersion pipe 130 is approximately ⅓~¼ of the refrigerant passage 140. The sectional area of the dispersion pipe 130 is smaller than that of the refrigerant passage 140. A plurality of dispersion holes 131 are formed at the opposite side (upper side in FIG. 1) of the dispersion pipe 130 against the refrigerant pipe 121. The size of the dispersion holes 131 increases with an increase in the distance from the refrigerant gate portion 107 comprising the expansion valve.

According to this laminated type heat exchanger 101, most of the refrigerant passing through the opening 180 flows into the dispersion pipe 130 without flowing directly into the refrigerant pipe 121. The refrigerant flowing in the dispersion pipe 130 passes through the dispersion holes 131, and flows into the refrigerant inlet chambers 120*a*. As explained above, the size of the dispersion holes 131 increases with an increase in the distance from the refrigerant gate portion 107. Therefore, the refrigerant is dispersed uniformly in the refrigerant inlet tank. The dispersed refrigerant flows into every refrigerant pipe 121, and disperses uniformly in the laminated type heat exchanger 101.

Moreover, the refrigerant inlet chambers 120*a* are positioned at the upper side of the laminated type heat exchanger 101 in this embodiment. However, it is absolutely possible to apply this embodiment to a laminated type heat exchanger comprising refrigerant inlet chambers 120*a* which are positioned at the lower side thereof.

Next, a second embodiment of the laminated type heat exchanger according to the present invention will be explained referring to FIG. 2. Moreover, in order to make the difference between the first embodiment and the following embodiments clear, the components in the first embodiment which are the same as the components in the following embodiments have the same reference numerals. Thereby, an explanation for those same components is omitted in the following embodiments.

Figure 2:
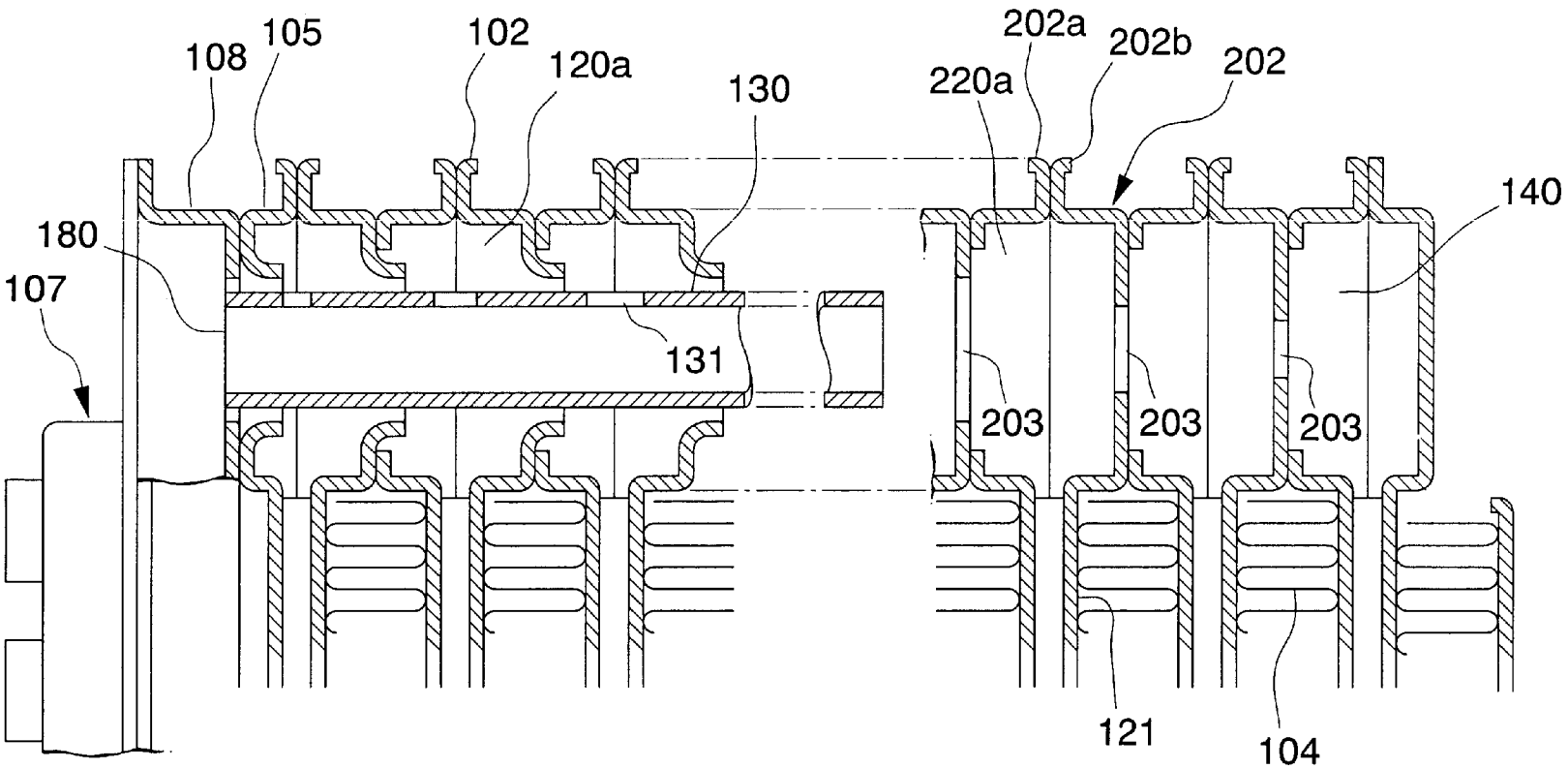
FIG. 2 is a longitudinal cross-sectional drawing showing the laminated type heat exchanger of the second embodiment according to the present invention.

In FIG. 2, reference numeral 220*a* indicates a refrigerant inlet chamber in which the dispersion pipe 130 is not inserted. The refrigerant inlet chamber 220*a* is formed by a tube element 202 comprising molded plates 202*a* and 202*b*. Similar to the molded plates 102*a* and 102*b*, an opening is formed at the molded plates 202*a* and 202*b*.

Thereby, the refrigerant passage 140 is formed by the refrigerant inlet chambers 120*a* in which the dispersion pipe 130 is inserted and the refrigerant inlet chambers 220*a* in which the dispersion pipe 130 is not inserted.

The size of openings 203 formed at the molded plates 202*b* is smaller that that of the openings formed at the molded plates 202*a*. In addition, the size of the openings 203 formed at the molded plates 202*b* decreases with an increase in the distance from the refrigerant gate portion 107. Thereby, the flow of the refrigerant is restricted.

In this second embodiment, the flow rate of the refrigerant increases whenever the refrigerant passes through the openings 203, having a reduced size with an increase in the distance from the refrigerant gate portion 107. Therefore, the refrigerant reaches the inner refrigerant inlet chambers 120*a* and 220*a*, and flows into the refrigerant pipes 121. Then, the refrigerant is dispersed uniformly in the laminated type heat exchanger 101.

Moreover, the openings 203, having a reduced size with an increase in the distance from the refrigerant gate portion 107, are formed at the molded plates 202*b* in this second embodiment. However, the opening 203 can be formed at the molded plate 202*a*. In addition, one or more dispersion plates, in which the opening 203 is formed, can also be provided in the refrigerant inlet chambers 220*a*. Furthermore, a plurality of holes, instead of one opening, can be formed at the dispersion plate.

Next, a third embodiment of the laminated type heat exchanger according to the present invention will be explained referring to FIG. 3A.

Figure 3B:
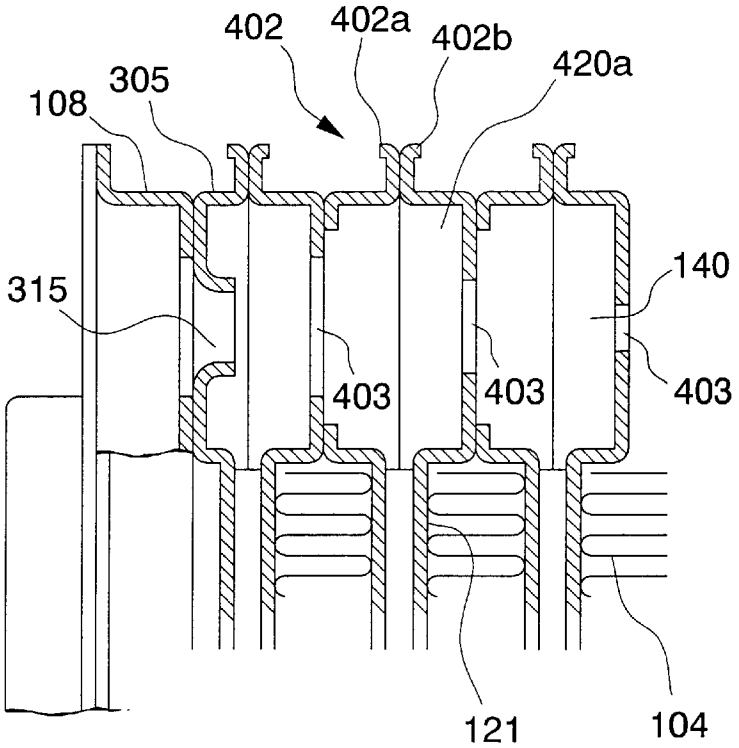
FIG. 3B is a partial longitudinal cross-sectional drawing showing the laminated type heat exchanger of the fourth embodiment according to the present invention.
Figure 3A:
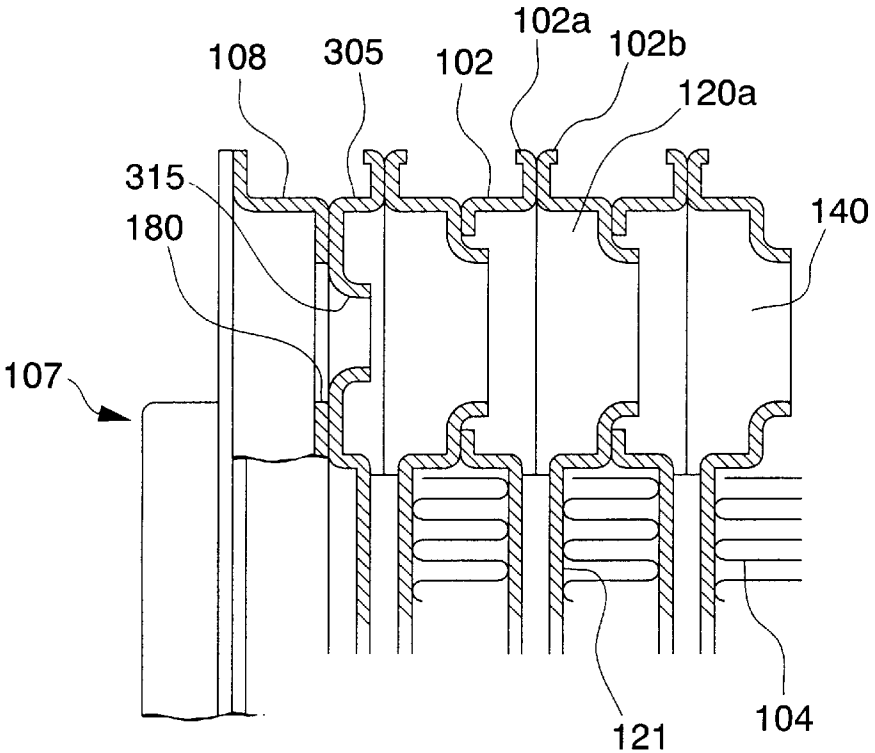
FIG. 3A is a partial longitudinal cross-sectional drawing showing the laminated type heat exchanger of the third embodiment according to the present invention.

In FIG. 3A, reference numeral 305 indicates an end plate attached to the molded plate 102*b* which is positioned at the upstream side of the refrigerant. The end plate 305 is attached between the molded plate 102*b* and the connection plate 108. A nozzle 315 is provided at the end plate 305. The diameter of the nozzle 315 is smaller than that of the opening 180 formed at the connection plate 108. Therefore, the nozzle 315 restricts the flow of the refrigerant from the refrigerant gate portion 107. When the refrigerant passes through the nozzle 315, a mist flow of the refrigerant is generated. Thereby, the flow rate of the refrigerant increases. The refrigerant reaches the inner refrigerant inlet chambers 120*a*, and flows into the refrigerant pipes 121. Then, the refrigerant is dispersed uniformly in the laminated type heat exchanger 101.

Moreover, the nozzle 315 is provided as a restrictor in this embodiment. However, an orifice can also be provided, instead of the nozzle 315.

Next, a fourth embodiment of the laminated type heat exchanger according to the present invention will be explained referring to FIG. 3B.

In FIG. 3B, reference numeral 420*a* indicates a refrigerant inlet chamber formed by a tube element 402 comprising molded plates 402*a* and 402*b*.

Openings 403 are formed at the molded plates 402*b*. The size of the openings 403 formed at the molded plates 402*b* decreases with an increase in the distance from the refrigerant gate portion 107. Thereby, the flow of the refrigerant is restricted.

Moreover, the nozzle 315 is provided at the end plate 305, similar to the third embodiment.

According to this fourth embodiment, the refrigerant in a mist flow is generated by the nozzle 315, and the flow rate of the refrigerant increases. Moreover, the inflow of the refrigerant into the refrigerant inlet chamber 420*a* is adjusted by the openings 403. In other words, the flow rate of the refrigerant increases due to the openings 403. Therefore, the refrigerant reaches the inner refrigerant inlet chamber 420*a*, and flows into the refrigerant pipes 121 connected to the refrigerant inlet chambers 420*a*. Then, the refrigerant is dispersed uniformly in the laminated type heat exchanger 101.

Moreover, the openings 403, having a reduced size with an increase in the distance from the refrigerant gate portion 107, are formed at the molded plates 402*b* in this fourth embodiment. However, the openings 403 can be formed at the molded plates 402*a*. In addition, one or more dispersion plates, in which the opening 403 is formed, can also be provided in the refrigerant inlet chambers 420*a*. Furthermore, a plurality of holes, instead of one opening, can be formed at the dispersion plate.

In addition, the refrigerant reaches the inner refrigerant inlet tank via the openings 403 in this fourth embodiment. In other words, the refrigerant passes through the refrigerant inlet tank via the openings 403 in this fourth embodiment. However, when the openings 403 are formed at the molded plates 402*a* and 402*b* forming the refrigerant outlet tank (not shown in the figures), the refrigerant passes through the refrigerant outlet tank.

Figure 4B:
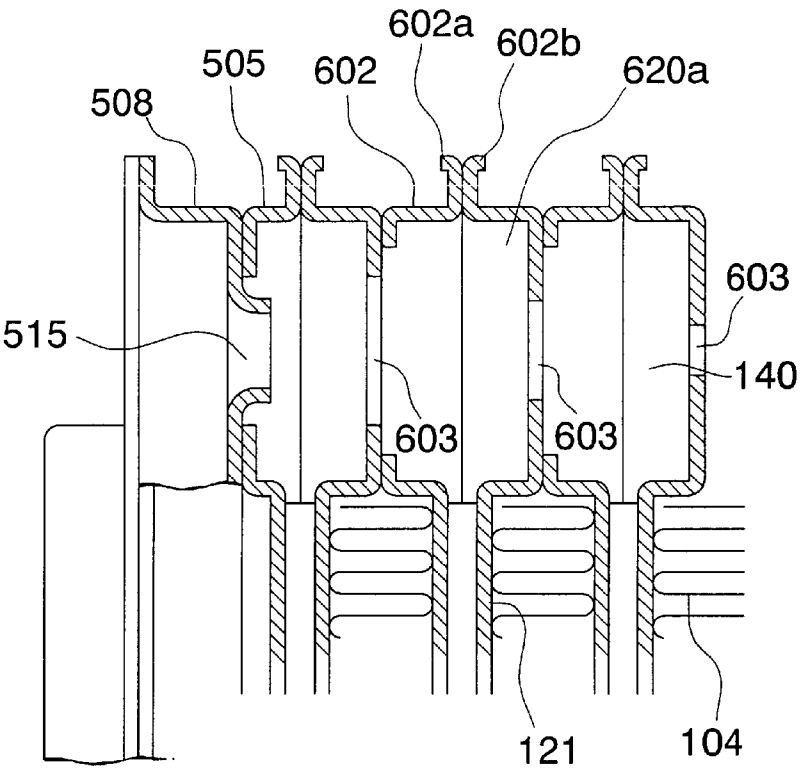
FIG. 4B is a partial longitudinal cross-sectional drawing showing the laminated type heat exchanger of the sixth embodiment according to the present invention.
Figure 4A:
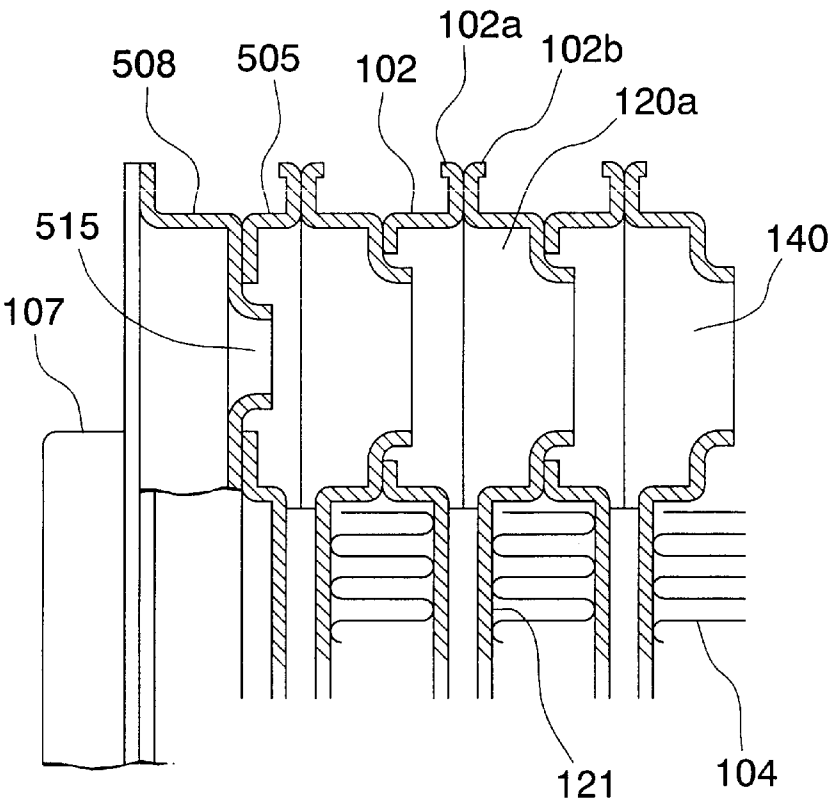
FIG. 4A is a partial longitudinal cross-sectional drawing showing the laminated type heat exchanger of the fifth embodiment according to the present invention.
Figure 5:
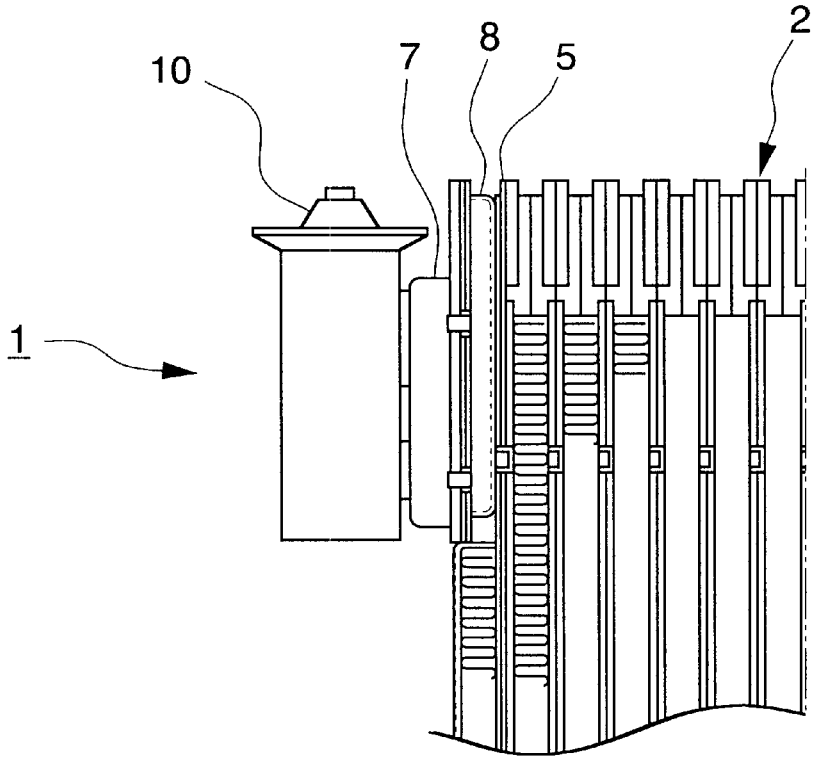
FIG. 5 is a partial side drawing showing a conventional laminated type heat exchanger used for an evaporator comprising an air conditioner mounted in a car.
Figure 6:
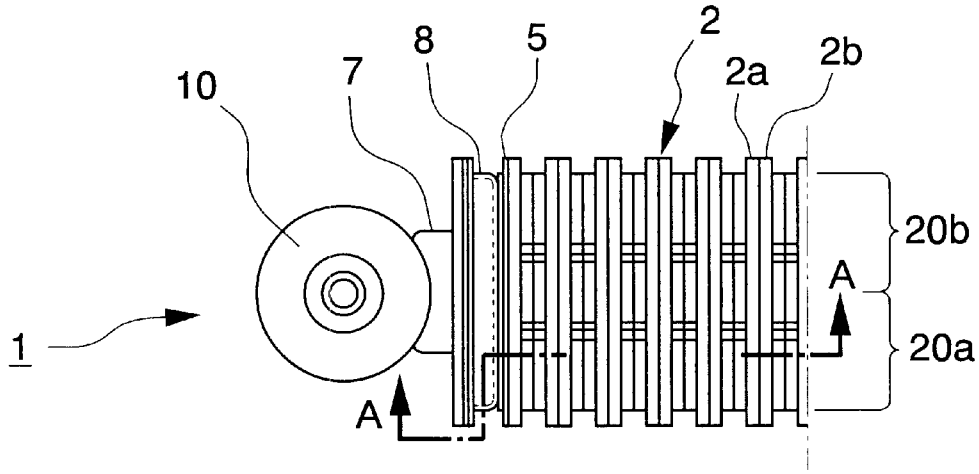
FIG. 6 is a partial plan drawing showing the conventional laminated type heat exchanger shown in FIG. 5.
Figure 7:
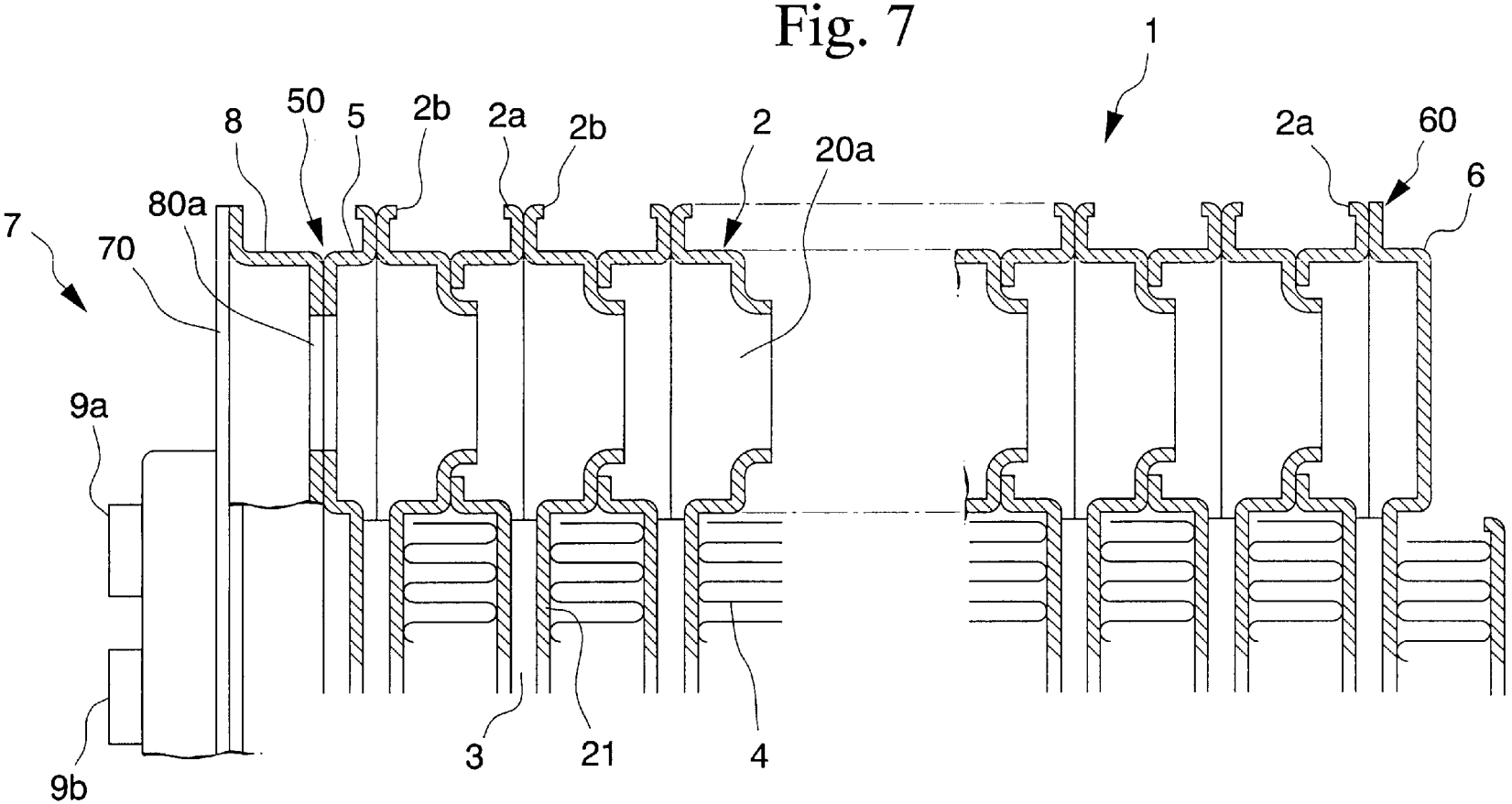
FIG. 7 is a sectional drawing showing a cross-section along line A—A of FIG. 6.

Next, a fifth embodiment of the laminated type heat exchanger according to the present invention will be explained referring to FIG. 4A.

In the third embodiment, the nozzle 315 is formed at the end plate 305 between the connection plate 108 and the molded plate 102*b*. However, as shown in FIG. 4A, a nozzle 515 is formed at a connection plate 508 in this fifth embodiment. The diameter of the nozzle 515 is smaller than that of the opening formed at an end plate 505. Similar to the third embodiment, the nozzle 515 restricts the flow of the refrigerant from the refrigerant gate portion 107. When the refrigerant passes through the nozzle 515, a mist flow of the refrigerant is generated. Thereby, the flow rate of the refrigerant increases. The refrigerant reaches the inner refrigerant inlet chambers 120*a*, and flows into the refrigerant pipes 121 connected to the refrigerant inlet chambers 120*a*. Then, the refrigerant is dispersed uniformly in the laminated type heat exchanger 101.

Moreover, the nozzle 515 is provided at the connection plate 508 as a restrictor in this embodiment. However, an orifice can also be provided instead of the nozzle.

Next, a sixth embodiment of the laminated type heat exchanger according to the present invention will be explained referring to FIG. 4B.

In the fourth embodiment, the nozzle 315 is formed at the end plate 305 between the connection plate 108 and the molded plate 402*b*. However, as shown in FIG. 4B, the nozzle 515 is formed at the connection plate 508 in this sixth embodiment. The diameter of the nozzle 515 is smaller than that of the opening formed at the end plate 505.

According to this sixth embodiment, similar to the fourth embodiment, the refrigerant in a mist flow is generated by the nozzle 515, and the flow rate of the refrigerant increases. Moreover, the inflow of the refrigerant into a refrigerant inlet chamber 620*a* is adjusted by openings 603. In other words, the flow rate of the refrigerant increases due to the openings 603. Therefore, the refrigerant reaches the inner refrigerant inlet chamber 620*a*, and flows into the refrigerant pipes 121 connected to the refrigerant inlet chambers 620*a*. Then, the refrigerant is dispersed uniformly in the laminated type heat exchanger 101.

Moreover, the openings 603, having a reduced size with an increase in the distance from the refrigerant gate portion 107, are formed at molded plates 602*b* in this sixth embodiment. However, the openings 603 can be formed at molded plates 602*a*. In addition, one or more dispersion plates, in which the opening 603 is formed, can also be provided in the refrigerant inlet chambers 620*a*. Furthermore, a plurality of holes, instead of one opening, can be formed at the dispersion plate.

In addition, the refrigerant reaches the inner refrigerant inlet tank via the openings 603 in this sixth embodiment. In other words, the refrigerant passes through the refrigerant inlet tank via the openings 603 in this sixth embodiment. However, when the openings 603 are formed at the molded plates 602*a* and 602*b* forming the refrigerant outlet tank (not shown in the figures), the refrigerant passes through the refrigerant outlet tank.

What is claimed is:

1. A laminated type heat exchanger comprising:

a refrigerant inlet tank comprising a plurality of refrigerant inlet chambers, and in which a refrigerant passage passing through the refrigerant inlet chambers is formed;

a refrigerant outlet tank comprising a plurality of refrigerant outlet chambers, and in which a refrigerant passage passing through the refrigerant outlet chambers is formed;

a plurality of refrigerant pipes each having one end which is connected to the refrigerant inlet chamber and the other end which is connected to the refrigerant outlet chamber;

a refrigerant gate portion for flowing the refrigerant into the refrigerant inlet tank and from the refrigerant outlet tank;

a dispersion pipe which is inserted in the refrigerant passage formed in the refrigerant inlet tank;

wherein the length of the dispersion pipe is ⅓~¼ of the length of the refrigerant passage in the refrigerant inlet tank, the sectional area of the dispersion pipe is smaller than that of the refrigerant passage in the refrigerant inlet tank, a plurality of dispersion holes are formed at the opposite side of the dispersion pipe against the refrigerant pipe, and the size of the dispersion holes increases with the increase in the distance from the refrigerant gate portion.

2. A laminated type heat exchanger according to claim 1, wherein at least one dispersion plate comprising an opening is provided in the refrigerant inlet chamber in which the dispersion pipe is not inserted.

3. A laminated type heat exchanger according to claim 2, wherein a plurality of said dispersion plates are provided in the refrigerant inlet tank, and the size of the openings formed at the dispersion plates decreases with an increase in the distance from the refrigerant gate portion.

4. A laminated type heat exchanger comprising:

a refrigerant inlet tank comprising a plurality of refrigerant inlet chambers, and in which a refrigerant passage passing through the refrigerant inlet chambers is formed;

a refrigerant outlet tank comprising a plurality of refrigerant outlet chambers, and in which a refrigerant passage passing through the refrigerant outlet chambers is formed;

a plurality of refrigerant pipes each having one end which is connected to the refrigerant inlet chamber and the other end which is connected to the refrigerant outlet chamber; and a refrigerant gate portion for flowing the refrigerant into the refrigerant inlet tank and from the refrigerant outlet tank;

wherein a restrictor for generating a mist flow of the refrigerant is provided at the upstream side of the refrigerant passage in the refrigerant inlet tank.

5. A laminated type heat exchanger according to claim 4, wherein said restrictor is formed at an end plate of the refrigerant inlet tank.

6. A laminated type heat exchanger according to claim 4, wherein said refrigerant gate portion comprises a connection plate for flowing the refrigerant into the refrigerant inlet tank, which is connected to an end plate of the refrigerant inlet tank; and a restrictor for restricting the flow of the refrigerant is provided at the connection plate.

7. A laminated type heat exchanger according to claim 4, wherein at least one dispersion plate comprising an opening for restricting the flow of the refrigerant is provided in the refrigerant inlet tank and/or the refrigerant outlet tank.

8. A laminated type heat exchanger according to claim 7, wherein a plurality of said dispersion plates are provided in the refrigerant inlet tank and/or the refrigerant outlet tank, and the size of the openings formed at the dispersion plates decreases with an increase in the distance from the refrigerant gate portion.

* * * * *